United States Patent [19]

Vitau

[11] 4,292,818

[45] * Oct. 6, 1981

[54] SETTING AND METHOD FOR MOUNTING PRECIOUS STONES AND THE LIKE THEREIN

[76] Inventor: Jean Vitau, 18 Ackerman Ave., Oradell, N.J. 07649

[ * ] Notice: The portion of the term of this patent subsequent to Sep. 16, 1997, has been disclaimed.

[21] Appl. No.: 76,135

[22] Filed: Sep. 17, 1979

[51] Int. Cl.[3] ..... A44C 17/02; B23P 5/00; A44C 17/04

[52] U.S. Cl. ..... 63/28; 29/10; 29/160.6

[58] Field of Search ..... 63/26, 27, 28; 29/160.6, 10

[56] References Cited

U.S. PATENT DOCUMENTS

| | | | |
|---|---|---|---|
| 303,424 | 8/1884 | Dutemple | 63/27 |
| 2,265,956 | 12/1941 | Schenck | 63/27 |
| 3,339,378 | 9/1967 | Chirol | 63/28 |

FOREIGN PATENT DOCUMENTS

| | | | |
|---|---|---|---|
| 2384468 | 11/1978 | France | 63/28 |

*Primary Examiner*—F. Barry Shay

*Attorney, Agent, or Firm*—Auslander, Thomas & Morrison

[57] ABSTRACT

A setting and a method for mounting precious stones and the like therein is provided with a mounting having at least two rows of at least two adjacent cavities with connecting portions therebetween and configured to receive stones with the peripheral portions thereof extending over contiguous connecting portions. A deformable securing slot is formed at each connection portion by fixing at least one elongated support member to the setting between the rows of cavities in alignment with the connecting portions with the longitudinal axis thereof normal to the top surface of the setting and by fixing a deformable securing rod at intermediate points to the other ends of the support member to dispose same parallel and spaced from the top surfaces of the setting. The slots are then deformed to admit the stones and to secure them in place.

12 Claims, 11 Drawing Figures

FIG. 1A
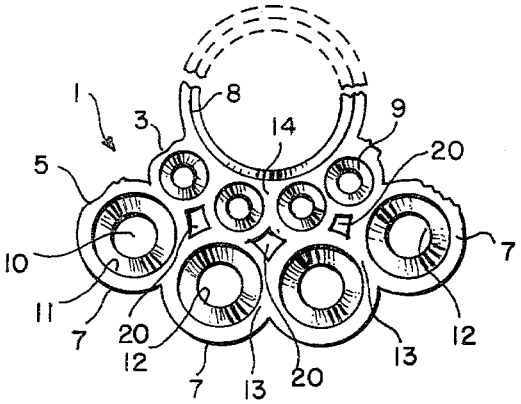
FIG. 1B
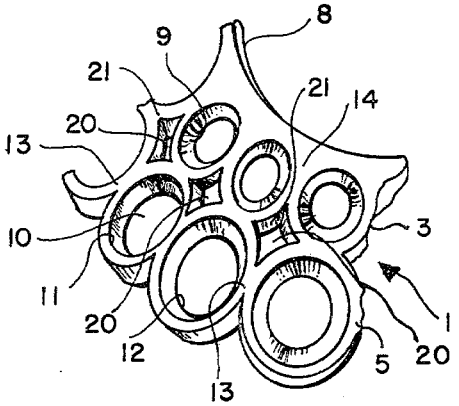
FIG. 2A
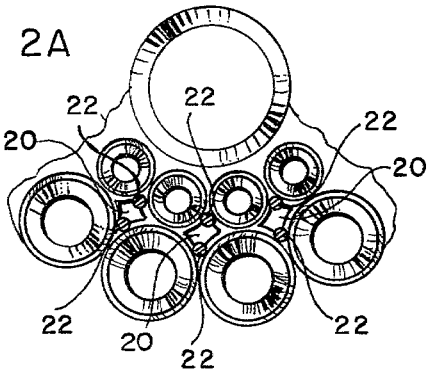
FIG. 2B
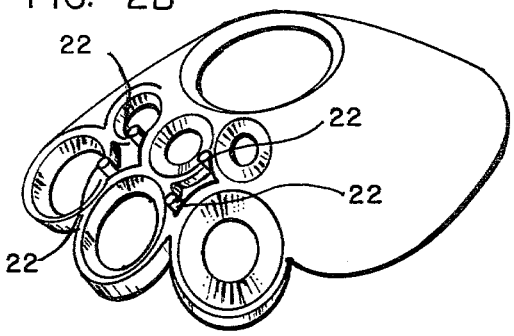
FIG. 3A
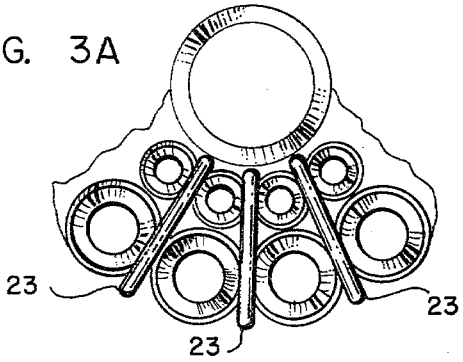
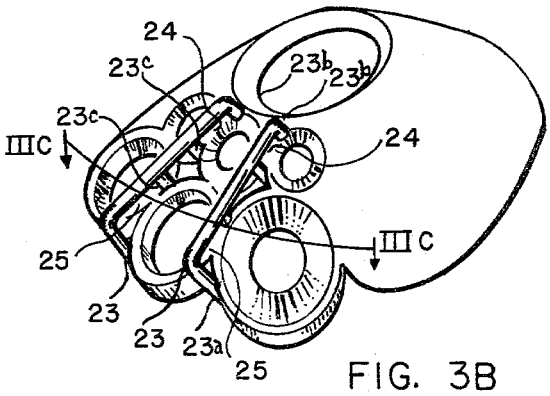
FIG. 3B
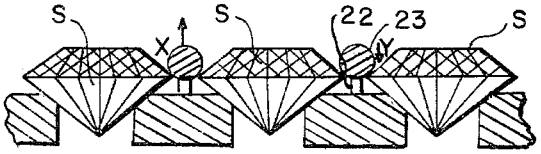
FIG. 3C

SETTING AND METHOD FOR MOUNTING PRECIOUS STONES AND THE LIKE THEREIN

BACKGROUND OF THE INVENTION

The present invention relates to a setting for precision stones or the like, a method for mounting the stones and more particularly, for mounting stones in a setting of at least two rows of at least two adjacent cavities.

Settings of this type are known, such as those disclosed in U.S. Pat. No. 3,339,378 and co-pending application Ser. No. 5,369 filed Jan. 22, 1979. In the known settings an unsupported strap or a strap supported by a complex support member is utilized. These have the disadvantage of not enabling the simple mounting of multiple rows of adjacent stones, especially diagonally disposed rows.

SUMMARY OF THE INVENTION

The main object of the present invention is to provide an improved setting for stones and an improved method for mounting stones in a setting.

Another object is to overcome the disadvantage of the prior art types of settings and methods for mounting stones.

These and other objects are achieved by the setting of the present invention for precious stones or the like comprising mounting means having a top surface and at least two rows of at least two adjacent cavities and aligned connecting portions connecting adjacent cavities, each cavity configured to receive a stone or the like from the top surface with a peripheral portion of each stone extending over the contiguous connecting portions and securing means defining securing slots with the top surface of selected connecting portions for receiving the peripheral portions of the stones to be mounted to secure same in position in their cavities, the securing means comprising at least one manually deformable securing rod positionable parallel to the top surface and spaced therefrom in alignment with the aligned connecting portions and at least one elongated support member mounted at one end to the mounting means between the two rows of the adjacent cavities in alignment with the connecting portions with the longitudinal axis thereof substantially normal to the top surface and fixed at the other end to the securing member intermediate of the end portions thereof.

In one embodiment illustrated herein, the portion of the mounting means between the two rows of two adjacent cavities comprises solid material and wherein the supporting member is mounted in an aperture therein.

In another embodiment illustrated herein, the position of the mounting means between the two rows of two adjacent cavities is hollow and wherein the support member is fixed to an interior surface of the hollow.

In a preferred embodiment, the support member comprises a cylindrical rod.

In a particularly advantageous embodiment of the invention, the mounting means comprises at least two diagonally offset rows of aligned cavities having a plurality of sets of diagonally aligned connecting portions with one support member mounted between each group of four adjacent cavities.

In another particularly advantageous embodiment, the mounting means comprises at least two concentric rows of radially aligned cavities having a plurality of sets of radially aligned connecting portions with two support members mounted between each group of four adjacent cavities.

The method for mounting precious stones or the like comprises the steps of providing a setting having a top surface, at least two rows of at least two adjacent cavities and aligned connecting portions connecting adjacent cavities, each cavity configured to receive a precious stone or the like therein from the top surface with a peripheral portion of each stone extending over the contiguous connecting portions, forming a deformably enlargeable and compressible securing slot at each connecting portion above the top surface of the setting and receptive of the peripheral portions of the stones by fixing one end of at least one elongated support member to the setting between the two rows of two adjacent cavities to dispose same in alignment with the connecting portions with the longitudinal axis thereof substantially normal to the top surface and fixing an intermediate portion of at least one manually deformable securing rod to the other end of the support member to dispose same parallel to and spread from the top surface and in alignment with the aligned connecting portions, deforming the slots to enlarge same and inserting the stones in the cavities with the peripheral portions in the slots and deforming the slots to compress same to secure the stones in place.

In the embodiment wherein the portion of the setting between the two rows of two adjacent cavities is solid material, the step of fixing the support member in the setting preferably comprises forming an aperture in the solid portion, inserting the support member in the aperture and soldering the support member in place. Preferably, the operation of forming an aperture is by drilling. In the embodiment wherein the portion of the setting between the two rows of two adjacent cavities is hollow, the step of fixing the support member in the setting preferably comprises soldering the support member to an interior surface of the hollow.

Further, where a setting comprising at least two diagonally offset rows of aligned cavities having a plurality of sets of diagonally aligned connecting portions is provided, the step of forming the slots preferably comprises fixing one support member between each group of four adjacent cavities.

Moreover, where a setting comprising at least two concentric rows of radially aligned cavities having a plurality of sets of radially aligned connecting portions is provided, the step of forming the slots preferably comprises fixing two support members between each group of four adjacent cavities.

Although such novel features believed to be characteristic of the invention are pointed out in the claims, the invention and the manner in which it may be carried out, may be further understood by reference to the description following and the accompanying drawings.

Numerous other features and advantages of the present invention will become apparent from the following specification when read in connection with the accompanying drawings wherein:

BRIEF DESCRIPTION OF THE DRAWINGS

FIGS. 1A and 1B are top and perspective views respectively of a setting in a first stage of the method of the present invention;

FIGS. 2A and 2B are top and perspective views of a setting in a second stage of the method of the present invention;

FIGS. 3A and 3B are top and perspective views respectively of a setting in a third stage of the method of the present invention;

FIG. 3C is a sectional view of FIG. 3B along line IIIc—IIIc of the setting of the present invention with the stones in place;

DETAILED DESCRIPTION OF THE INVENTION

Figure 4A:
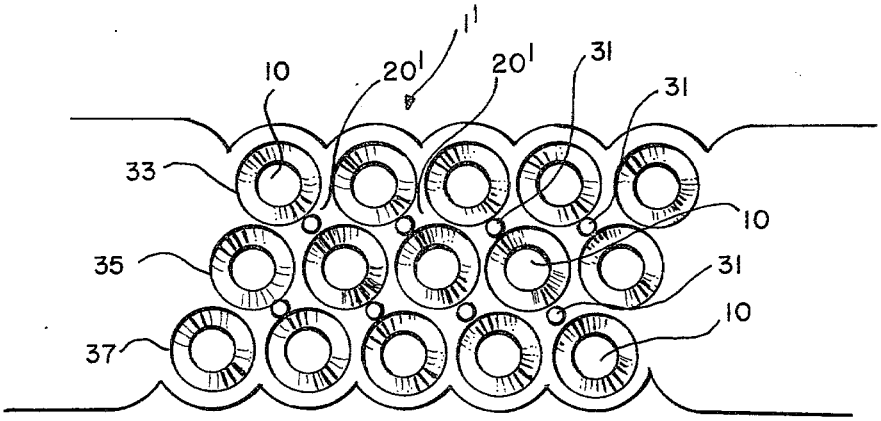
FIGS. 4A and 4B are top and perspective views respectively of another setting in the second stage of the method of the present invention.

Referring now to the figures in greater detail, where like reference numbers denote like parts in the various figures.

Referring now to FIGS. 1A and 1B, a setting 1 composed of a precious metal or the like, includes two rows 3 and 5 of frustoconical bezels 9 and 7 respectively defining cavities 10. The rows 3, 5 are shown in radial alignment around a center bezel 8. However, this is shown only for the purposes of illustrating the present invention.

The bezels 7 and 9 each include upper and lower stone-mounting edges 11 and 12. It will be apparent that the bezels can have other traditional stone-holding shapes and that the edges are optional and the settings may alternatively comprise any cavity of the proper configuration for the stones to be used.

Between each pair of adjacent cavities 10 is situated a connecting portion 13, 14. The width of the connecting portion is determined by the amount of overlap by the periphery of the stones S to be mounted as is illustrated in FIG. 3C.

In the embodiment shown, the setting 1 has a hollowed portion 20 disposed between the adjoining cavities 10, with an inner surface 21. The shape of the hollow portion 20 is preferably substantially diamond-shaped as shown; however, other shapes can be used which are aesthetically pleasing for the setting.

The mounting of the stones is carried out with reference to FIGS. 2A and 2B, by first fixing the elongated support members 22 into the setting. The members 22 are composed of metal, preferably precious metal, which has the same appearance as the setting and are preferably cylindrical wires, but can have any cross section. The support members 22 are fixed by preferably soldering one end to the inner surface 21 of the hollow 20, in alignment with the radially extending connecting portions 13, 14.

Thereafter, as shown in FIGS. 3A and 3B, manually deformable securing rods 23 are disposed substantially parallel to the top surface of the setting. The top portion of the members 22 are affixed, preferably by soldering, to points 23*c* intermediate of the end portions of the rods 23. One end 23*a* of a rod 23 is bent over the outer periphery of the setting 1 and affixed thereto, preferably by soldering, and the other end 23*b* is bent downwardly to the top surface of the setting and affixed thereto, preferably by soldering. In this way, securing slots 24, 25 are formed.

The deformable rods 23 are preferably of cylindrical shape, but can alternatively have a flat, oval or rectangular cross section. The rods 23 are composed of a deformable material, preferably a precious metal which has the same appearance as the setting 1.

In order to mount a stone S in the setting thus formed, the rod 23, between the end portions thereof and the members 22, is deformed upwardly as shown by arrow X in FIG. 3C so that the slot 24, 25 is enlarged. The stones S are then placed in position in cavities 10, with their peripheral portions overlying the connecting portions 13, 14 and thus in slots 24, 25. Thereinafter, the rods 23 are deformed downwardly as shown by arrow Y, compressing the slots 24, 25 and securing the stones S in position.

Figure 4B:
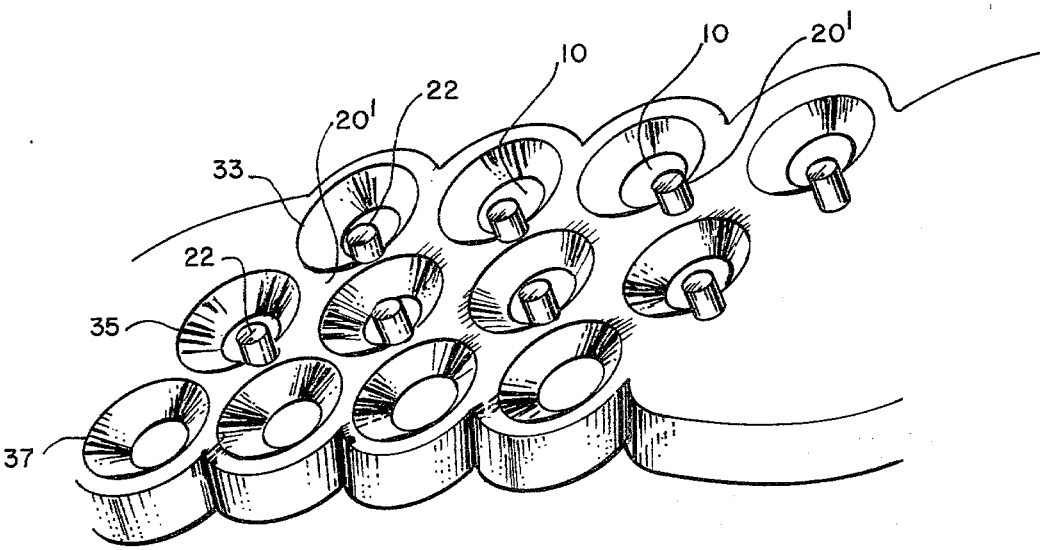

In the embodiment shown in FIGS. 4A and 4B, a setting 1', having diagonally offset rows 33, 35, 37 of cavities 10 are provided; however, the space 20' between four adjacent cavities 10, is solid metal. Thus, in order to fix the support members 22 in place, holes 31 are formed in portions 20', preferably by drilling. Since drilling is the most advantageous method, the members 22 preferably have a circular cross section. However, the holes 31 can be formed by other well known metal working techniques. The members 22 are fixed in holes 31, preferably by soldering.

Figure 5A:
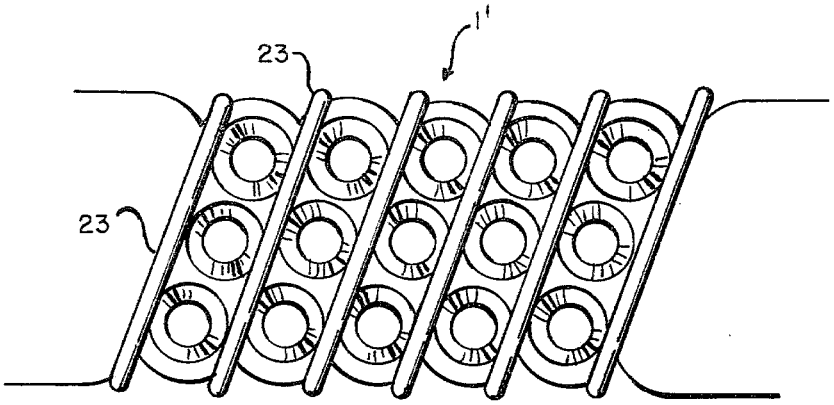
FIGS. 5A and 5B are top and perspective views respectively of the setting of FIGS. 4A and 4B in the the third stage of method of the present invention.
Figure 5B:
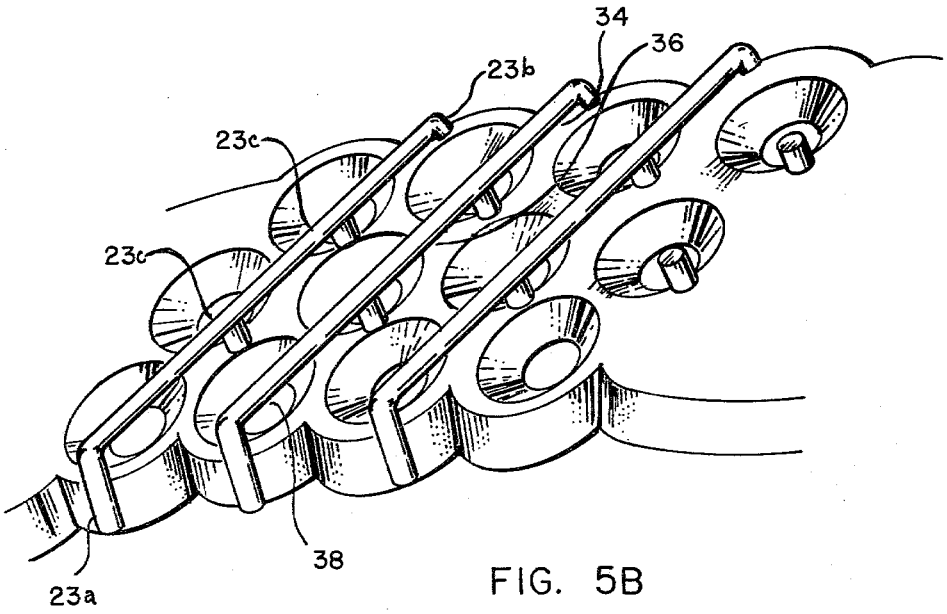

Turning now to FIGS. 5A and 5B, the setting is completed by fixing securing rods 23 to the support members 22 in a diagonally parallel configuration, preferably by soldering, at the intermediate point 23*c*. The end portions 23*a* and 23*b* of rods 23 are bent down over the respective sides of the setting 1' and fixed thereto, preferably by soldering. In this way, securing slots 34, 36, 38 are formed. The stones are then mounted by deforming rods 23 as in the previously described embodiment.

It is evident that those skilled in the art may now make numerous modifications to the specific embodiments described herein without departing from the inventive concept.

The terms and expressions which are employed are used as terms of description and it is recognized that various modifications may be possible.

It is also understood that the following claims are intended to cover all of the generic and specific features of the invention herein described, and all statements of the scope of the invention which, as a matter of language, might fall therebetween.

Having described certain forms of the invention in some detail, what is claimed is:

1. A setting for precious stones or the like comprising: mounting means having a top surface and comprising at least two rows of cavities each row having at least two adjacent cavities and aligned connecting portions connecting adjacent cavities, each cavity configured to receive a stone or the like from the top surface with a peripheral portion of each stone extending over the contiguous connecting portions; and securing means defining securing slots with the top surface of selected connecting portions for receiving the peripheral portions of the stones to be mounted to secure same in position in their cavities, the securing means comprising at least one deformable securing rod positionable parallel to the top surface and spaced therefrom in alignment with the aligned connecting portions and at least one elongated support member mounted at one of its ends to the mounting means between the two rows of two adjacent cavities in alignment with the connecting portions with the longitudinal axis thereof substantially normal to the top surface and fixed at the other of its ends to the securing means intermediate of the end portions thereof.

2. The setting according to claim 1, wherein the portion of the mounting means between the two rows each of two adjacent cavities comprises solid material and wherein the supporting means is mounted in an aperture therein.

3. The setting according to claim 1, wherein the portion of the mounting means between the two rows of two adjacent cavities is hollow and wherein the support member is fixed to an interior surface of the hollow.

4. The setting according to claim 2 or claim 3, wherein the support member comprises a cylindrical rod.

5. The setting according to claim 1, wherein the mounting means comprises at least two rows of cavities, the cavities in one of said two rows being diagonally offset from corresponding ones of said cavities in the other of said two rows, said setting having a plurality of sets of diagonally aligned connecting portions between adjacent cavities with one support member mounted between each group of four adjacent cavities.

6. The setting according to claim 1, wherein the mounting means comprises at least two diagonally offset rows of aligned cavities having a plurality of sets of diagonally aligned connecting portions with one support member mounted between each group of four adjacent cavities.

7. A method for mounting precious stones or the like, comprising the steps of:

providing a setting having a top surface, at least two rows of cavities each row having at least two adjacent cavities and aligned connecting portions connecting adjacent cavities, each cavity configured to receive a precious stone or the like therein from the top surface with a peripheral portion of each stone extending over the contiguous connecting portions;

forming a deformably enlargeable and compressible securing slot at each connecting portion above the top surface of the setting and receptive of the peripheral portions of the stones by fixing one end of at least one elongaged support member to the setting between the two rows of two adjacent cavities to dispose same in alignment with the connecting portions with the longitudinal axis thereof normal to the top surface and fixing an intermediate portion of at least one deformable securing rod to the other end of the support member to dispose same parallel to and spaced from the top surface and in alignment with the aligned connecting portions;

deforming the slots to enlarge same and inserting the stones in the cavities with the peripheral portions in the slots; and deforming the slots to compress same to secure the stones in place.

8. The method according to claim 7, wherein the portion of the setting between the two rows of two adjacent cavities is solid material and wherein the step of fixing the support member in the setting comprises forming an aperture in the solid portion, inserting the support member in the aperture and soldering the support member in place.

9. The method according to claim 8, wherein the aperture is formed by drilling.

10. The method according to claim 7, wherein the portion of the setting between the two rows of two adjacent cavities is hollow and wherein the step of fixing the support member in the setting comprises soldering the support member to an interior surface of the hollow.

11. The method according to claim 7, further comprising providing a setting comprising at least two rows of cavities, the cavities in one of said two rows being diagonally offset from corresponding cavities in the other of said two rows, said setting having a plurality of sets of diagonally aligned connecting portions between adjacent cavities and wherein the step of forming the slots comprises fixing one support member between each group of four adjacent cavities.

12. The method according to claim 7, further comprising providing a setting comprising at least two concentric rows of radially aligned cavities having a plurality of sets of radially aligned connecting portions and wherein the step of forming the slots comprises fixing two support members between each group of four adjacent cavities.

* * * * *